US009111421B2

(12) United States Patent
Soong et al.

(10) Patent No.: US 9,111,421 B2
(45) Date of Patent: Aug. 18, 2015

(54) WAGERING GAME WITH HOT PICK BONUS

(75) Inventors: Kenneth Shawn Soong, Henderson, NV (US); Michael Stacey, Las Vegas, NV (US); Ricco Novero, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 201 days.

(21) Appl. No.: 13/053,107

(22) Filed: Mar. 21, 2011

(65) Prior Publication Data

US 2012/0034966 A1 Feb. 9, 2012

Related U.S. Application Data

(60) Provisional application No. 61/371,598, filed on Aug. 6, 2010.

(51) Int. Cl.
*G07F 17/32* (2006.01)

(52) U.S. Cl.
CPC ..... *G07F 17/3262* (2013.01); *G07F 17/3267* (2013.01)

(58) Field of Classification Search
CPC ..... G07F 17/3267; G07F 17/3262
USPC ..... 463/16–20, 25, 29–31
See application file for complete search history.

(56) References Cited

U.S. PATENT DOCUMENTS

| | | | | |
|---|---|---|---|---|
| 6,155,925 | A * | 12/2000 | Giobbi et al. | 463/20 |
| 6,648,758 | B2 * | 11/2003 | Bennett et al. | 463/20 |
| 6,769,986 | B2 * | 8/2004 | Vancura | 463/30 |
| 7,121,942 | B2 * | 10/2006 | Baerlocher | 463/20 |
| 7,354,344 | B2 * | 4/2008 | Paulsen et al. | 463/20 |
| 2001/0009865 | A1 * | 7/2001 | Demar et al. | 463/20 |
| 2002/0025846 | A1 * | 2/2002 | Bennett et al. | 463/20 |
| 2004/0048657 | A1 * | 3/2004 | Gauselmann | 463/25 |
| 2005/0215311 | A1 * | 9/2005 | Hornik et al. | 463/20 |
| 2006/0025201 | A1 * | 2/2006 | Van Asdale | 463/20 |
| 2007/0060252 | A1 * | 3/2007 | Taylor | 463/16 |
| 2008/0064481 | A1 * | 3/2008 | Jackson et al. | 463/20 |
| 2008/0085755 | A1 * | 4/2008 | Okada | 463/20 |
| 2008/0139289 | A1 * | 6/2008 | Okada | 463/20 |
| 2009/0131145 | A1 * | 5/2009 | Aoki et al. | 463/20 |
| 2009/0176552 | A1 * | 7/2009 | Hornik et al. | 463/20 |
| 2010/0004047 | A1 * | 1/2010 | Acres | 463/20 |

FOREIGN PATENT DOCUMENTS

JP 2003220174 A 8/2003

* cited by examiner

*Primary Examiner* — David L Lewis
*Assistant Examiner* — Shauna-Kay Hall
(74) *Attorney, Agent, or Firm* — Philip J. Anderson; Marvin A. Hein; Brooke W. Quist

(57) ABSTRACT

Disclosed are games, gaming machines, gaming systems and methods including a hot pick bonus. A player selects one of a number of indicia/symbols and initiates a primary slot machine game spin. If a predetermined number of the selected symbols appear as the result of the spin, a bonus feature is initiated. Because the symbols selectable by the player occur with different frequency on the reels, the symbol chosen by the player affects the likelihood of triggering a bonus game. In general, the amount won in a bonus game is correlated to the frequency with which the selected triggering symbol combination may occur.

16 Claims, 11 Drawing Sheets

FIG. 2

| Minimum | | Maximum | Average | Per Spin | | Pulls per | | Pulls per |
|---|---|---|---|---|---|---|---|---|
| Symbol | Hits | Value | Value | Value | Hit Prob | EV | Hit | Jackpot |
| WC | 729 | 125 | 1250 | 243.14 | 0.0007 | 0.1772 | 1371 | 3083938 |
| A3 | 486 | 100 | 1000 | 365.38 | 0.0004 | 0.1775 | 2057 | 3102154 |
| A2 | 1296 | 50 | 500 | 136.87 | 0.0012 | 0.1773 | 771 | 3120739 |
| A1 | 8100 | 10 | 100 | 21.94 | 0.0081 | 0.1777 | 123 | 3144778 |
| B2 | 42707 | 2 | 20 | 4.15 | 0.0427 | 0.1773 | 23 | 3166654 |
| B1 | 60314 | 1 | 10 | 2.94 | 0.0603 | 0.1774 | 16 | 3183324 |

FIG. 3

| Symbol | Pulls per Hit | Pay Range |
|---|---|---|
| Wild | 1,372 | 125x-1250x |
| Red 7 | 2,058 | 100x-1000x |
| Blue 7 | 772 | 50x-500x |
| Green 7 | 123 | 10x-100x |
| Bar 5 | 23 | 2x-20x |
| Bar 1 | 17 | 1x-10x |

WAGERING GAME WITH HOT PICK BONUS

CROSS-REFERENCE TO RELATED APPLICATIONS

This application is related to U.S. application Ser. No. 12/828,183, filed Jun. 30, 2010, which is incorporated by reference in its entirety, which claims the benefit of U.S. Provisional Application No. 61/261,452, filed Nov. 16, 2009, which is also incorporated by reference in its entirety. This application claims the benefit of U.S. Provisional Application No. 61/371,598, filed Aug. 6, 2010, which is also incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND

1. Field of the Disclosure

This disclosure is directed to wagering games, gaming machines, networked gaming systems and methods and, more particularly, to wagering games, gaming machines, networked gaming systems and methods having a player-selectable bonus trigger.

2. Description of the Related Art

In the prior art, various types of gaming machines have been developed with different features to captivate and maintain player interest. In general, a gaming machine allows a player to play a game in exchange for a wager. Depending on the outcome of the game, the player may be entitled to an award which is paid to the player by the gaming machine, normally in the form of currency or game credits. Gaming machines may include flashing displays, lighted displays, or sound effects to capture a player's interest in a gaming device.

Another important feature of maintaining player interest in a gaming machine includes providing the player with many opportunities to win awards, such as cash or prizes. For example, in some slot machines, the display windows show more than one adjacent symbol on each reel, thereby allowing for multiple-line betting. Feature games of various types have been employed to reward players above the amounts normally awarded on a standard game pay schedule. Generally, such feature games are triggered by predetermined events such as one or more appearances of certain combinations of indicia in a primary game. In order to stimulate interest, feature games are typically set to occur at a gaming machine on a statistical cycle based upon the number of primary game plays.

Some gaming machine games today include one or more progressive prize awards. In some configurations, the progressive prize may have a small probability of being won by a player. Such a configuration makes it possible to have a larger progressive prize. In other game configurations, the progressive prize may be a small amount, which enables a player to win the progressive prize more frequently. In most typical game configurations, the player wins the progressive prize as a result of a specific game outcome within the primary or main game.

While gaming machines including feature games and progressive prizes have been very successful, there remains a need for games that provide a player with enhanced excitement and increased opportunity of winning. In particular, there remains a need for a game in which the player may choose between a frequently occurring small award and an infrequently occurring large award.

SUMMARY OF THE INVENTION

A gaming system for playing a base game and a bonus game having a plurality of symbol indicia that are selectable prior to play of the base game and are associated with the bonus game is disclosed. The system includes: an interactive display screen, a plurality of reel indicia, one or more player-activated buttons, and a processor. The interactive display screen displays the plurality of selectable symbol indicia to a player and for receiving player input, wherein prior to play of the base game, the player selects one of the pluralities of symbol indicia. Each of the plurality of symbol indicia is associated with a bonus game having a different bonus hit frequency and bonus prize pay range, enabling the player to select a bonus hit frequency and a bonus prize pay range by selecting the associated symbol indicia. The pluralities of reel indicia are spun during the play of the base game. One or more player-activated buttons receive player input. The processor executes game software and processes input from the player-activated buttons. Activation of the base game includes rotating of the plurality of reel indicia, wherein display of particular symbol indicia on one or more of the reels after the rotation has stopped determines whether a winning game outcome has occurred. A bonus game that has a higher bonus hit frequency has a lower bonus prize pay range, and a bonus game that has a lower bonus hit frequency has a higher bonus prize pay range. Preferably, selection of the symbol indicia does not change an overall return to the player of the game.

Other features and advantages will become apparent from the following detailed description, taken in conjunction with the accompanying drawings, which illustrate by way of example, the features of the various embodiments.

BRIEF DESCRIPTION OF THE DRAWINGS

FIGS. 2-3 illustrate sample summary data and hit frequencies for a game in accordance with one or more embodiments.

DETAILED DESCRIPTION

Figure 1A:
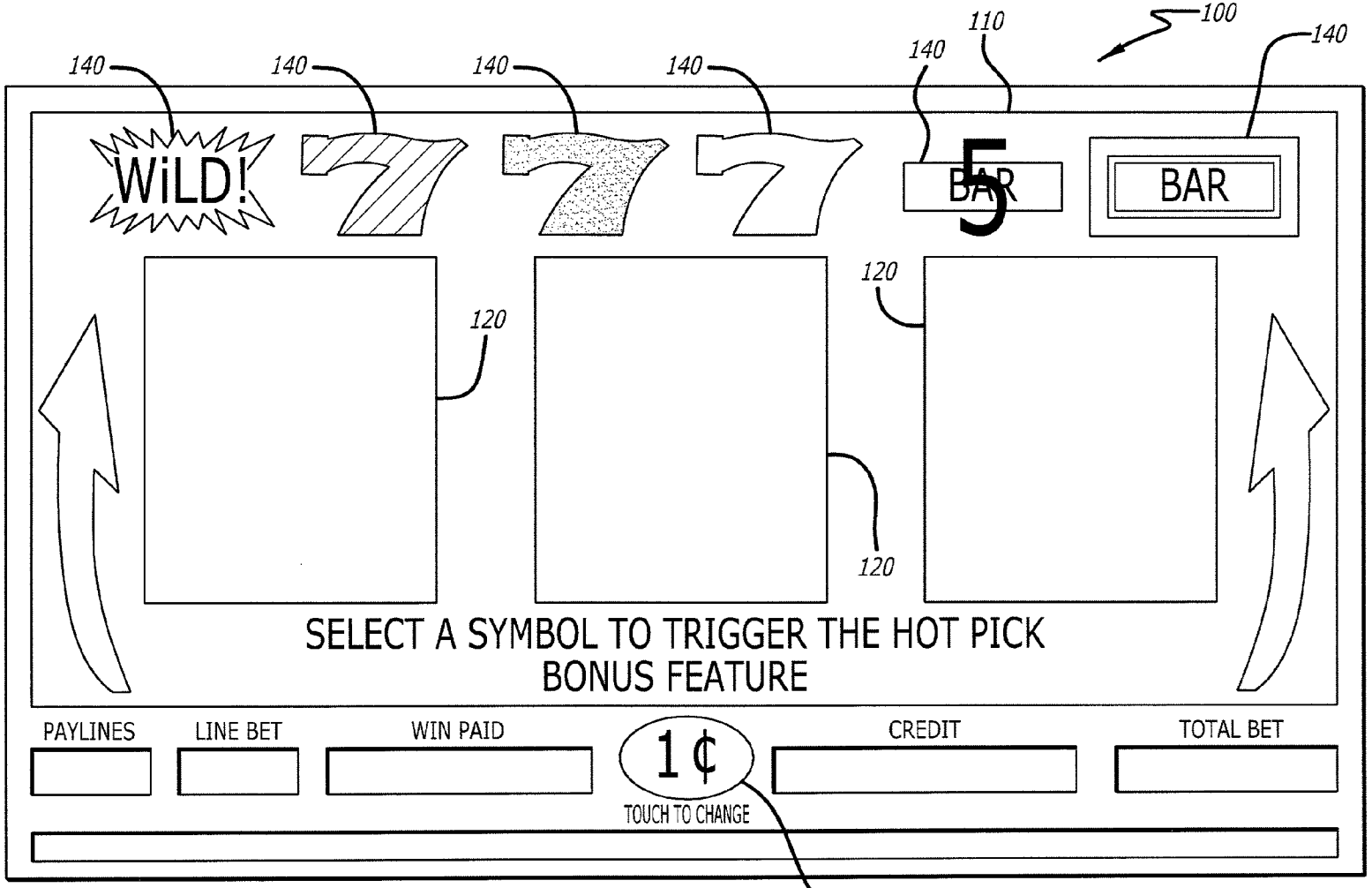
FIGS. 1A-C are display images associated with an example game in accordance with one or more embodiments.
Figure 1B:
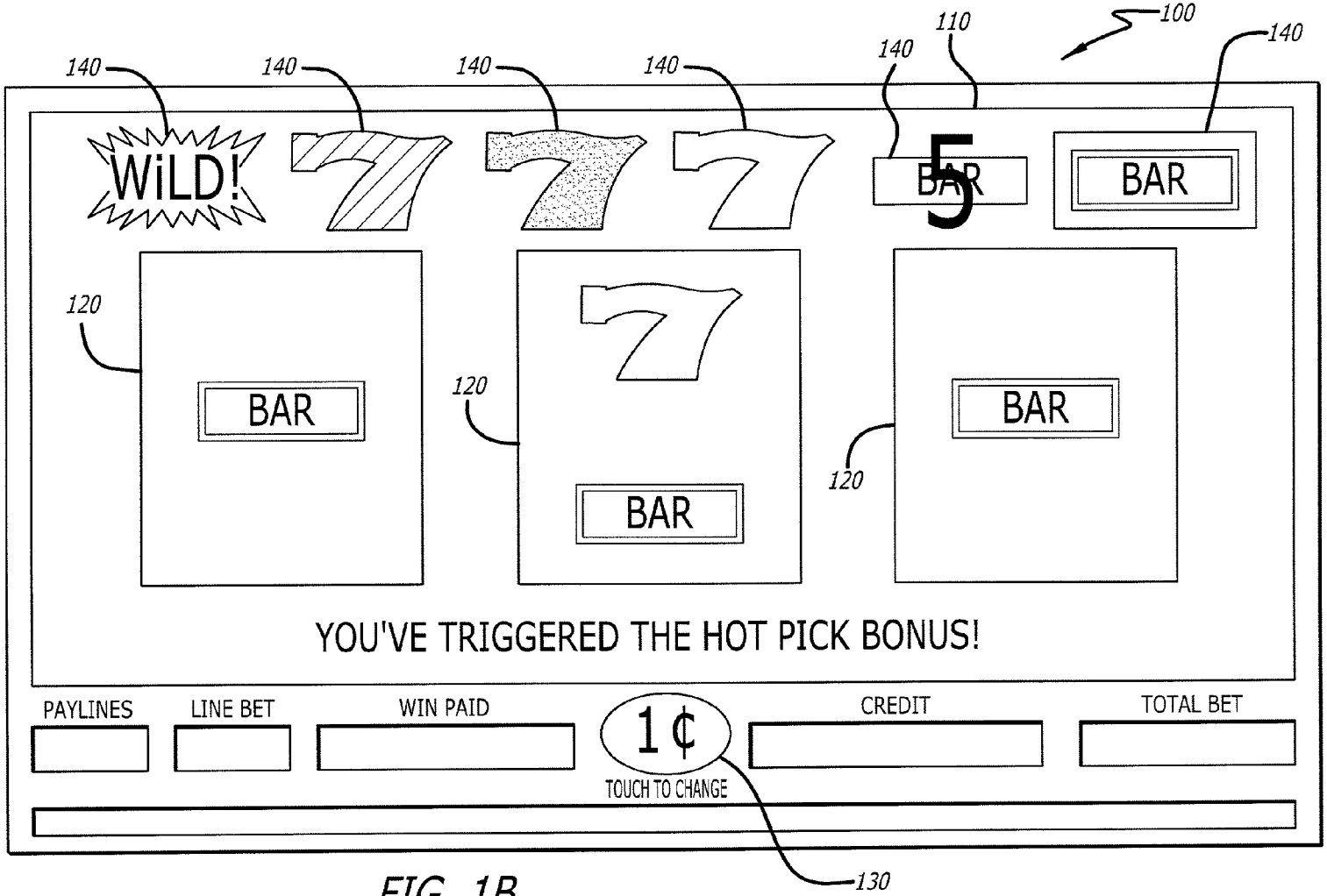

Various embodiments are directed to a game, gaming machine, gaming networks and method for playing a game, wherein the game includes adjustable multi-part indicia. The embodiments are illustrated and described herein, by way of example only, and not by way of limitation. Referring now to the drawings, and more particularly to FIGS. 1-8, there are shown illustrative examples of games, gaming machines, gaming networks and methods for playing a game in accordance with various aspects of the invention.

An example game in accordance with one or more aspects of the disclosed embodiments is shown in FIGS. 1-3. Referring to FIG. 1, a wagering game with a hot pick bonus 100 is implemented on an interactive display screen 110 using the indicia of three spinning reels 120. A number of pay line patterns (not shown) passes through one indicium on each of the three reels. For example, a first pay line may extend horizontally through the top row of each of the three reels. The disclosed embodiment of the wagering game with a hot pick bonus 100 may be implemented with any number of reels and any number of selected symbols appearing to trigger the bonus feature. The number of pay lines and their patterns are by way of example only and may vary.

The player selects the number of played pay lines and the number of credits or coins wagered on each line using touch screen controls or gaming device control buttons 130. A win PAID meter and CREDITS meter provide the player with information about the amount paid by the last game played and the total number of credits available for play. A TOTAL BET meter displays the size of the currently selected wager. The player may collect the balance of his credits by pressing a COLLECT button (not shown).

In one embodiment, prior to the initiation of a spin of the primary game, the player selects (by touching a touchscreen or by another selection means) one of a number of indicia/symbols 140. The player then initiates the primary game spin. If three, for example, of the selected symbol appear on a payline or are scattered as the result of the spin, the bonus feature is initiated. For example, shown in FIG. 1A, the player has selected the "BAR" symbol. The reels then spin, resulting in an outcome shown in FIG. 1B.

The player is paid for all line wins appearing (in this case, three Bars on payline 7). Then, because the player selected "Bar" and three Bars appear in the reel window, the bonus is initiated. In one embodiment, the bonus is an onscreen wheel feature, but any feature game may be triggered by a player's "successful" selection.

Figure 1C:
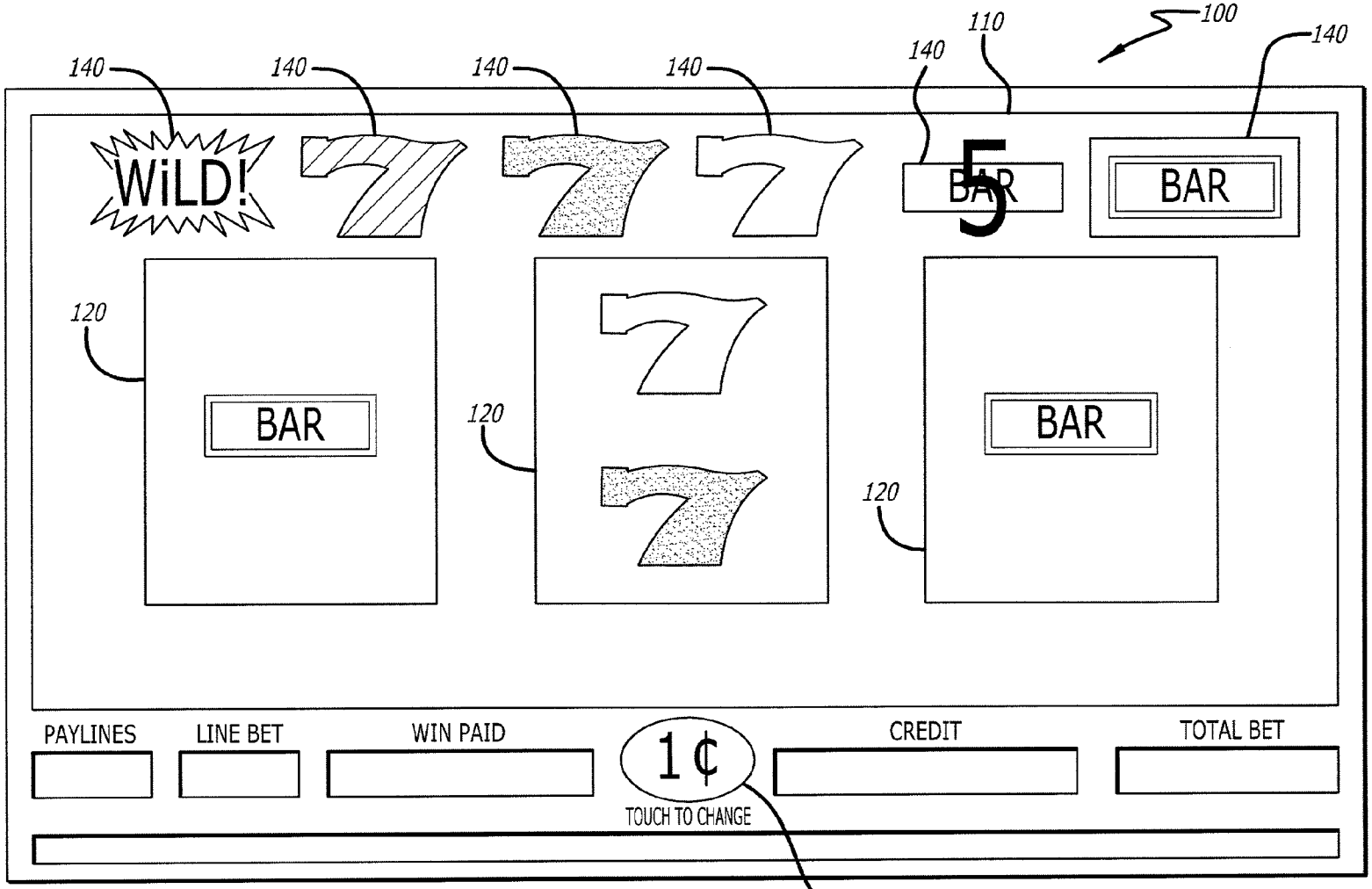

In the present example, because the player selected "Bar," had the spin not contained three scattered Bars, the bonus feature would not have been initiated. An example of such an unsuccessful outcome is shown in FIG. 1C.

One embodiment requires that three "natural" selected symbols to appear; substitutions as the results of wilds and mixed bars or mixed sevens do not apply toward initiating the bonus. However, another embodiment may allow such substitutions. In some embodiments, the availability of the feature game may be restricted based on the size of the wager.

FIG. 3 provides an example of summary data from the mathematics of an example of a Hot Pick Bonus triggering scheme in accordance with one embodiment. Because different symbols appear with different frequencies, the player may select the hit frequency and volatility of their bonus experience. For example, one embodiment allows the player to select one of six symbols, each with a different hit frequency and pay range

| Symbol | Pulls per Hit | Pay Range |
|---|---|---|
| Wild | 1,372 | 125x-1250x |
| Red 7 | 2,058 | 100x-1000x |
| Blue 7 | 772 | 50x-500x |

-continued

| Symbol | Pulls per Hit | Pay Range |
|---|---|---|
| Green 7 | 123 | 10x-100x |
| Bar 5 | 23 | 2x-20x |
| Bar 1 | 17 | 1x-10x |

As shown, there is an increased player interactivity on every spin and player control over the play experience, in terms of bonus frequency and volatility.

In operation, the player initiates game play by pressing a SPIN/ENROLL touch screen button. In some embodiments, the player may simultaneously select all pay lines at the maximum number of coins or credits allowed per line by pressing a MAX BET button (not shown). Buttons (see FIG. 4, 460) on gaming machine 400 (FIG. 4) or other touch screen buttons may be used to perform the actions described here without deviating from the scope of the disclosed embodiments. The reels 101-105 are made to spin and stop in predetermined stop positions. A determination is then made whether the stop positions of the reels resulted in a winning game outcome.

The player may view the pay table associated with the primary game on the primary game display by way of a HELP/PAYS or similar button. In alternate embodiments, the pay table may be presented on a second video or printed display attached to the gaming device (i.e., display 453 or "pay glass" 452, FIG. 4). A winning combination, for example, could be three or more symbols adjacent to one another on an active pay tine. For each winning combination, the game device awards the player the award in the pay table, adjusted as necessary based on the number of credits wagered on the pay line on which the win occurred. For example, three RED 7 symbols adjacent to one another from left-to-right on an active pay line might pay 100 times the player's wager.

In accordance with one or more embodiments, progressive prizes may be awarded as part of primary or feature game play. The progressive prizes may be calculated by a progressive controller such as a controller manufactured by Mikohn, Inc. The progressive controller monitors wagering during base game play, calculates a current value for one or more progressive jackpot pools and transmits the current pool values to the gaming machine. In one or more embodiments, progressive awards are accumulated during regular play as a percentage, such as three percent, of the game play take. The prizes may be sized according to the preferences of the casino operator. The number of prizes may vary without deviating from the scope of the disclosed embodiments. The size of the prizes is dependent on the amount of play prior to initiating feature play and may come from the contributions of a single gaming machine or a number of linked gaming machines. In another aspect, the prizes may be set amounts established by the casino operator from non-coin-in funds, such as marketing funds.

In one or more embodiments, the prizes for feature game play may be accumulated based on funding mechanisms other than a percentage of wagers accumulated by the gaming machine. For example, an operator may initially fund various award pools with a pre-determined amount of money, such as $1000 for one progressive, $500 for a second progressive, $100 for a third progressive. The amounts of one or more of the awards at pre-determined times may be periodically or randomly selected with a range of times or periods. Once a win has occurred at any level, the award levels may be rolled back to the initial funding level. In one or more embodiments, only the winning award level is rolled back to the initial funding level.

In one or more embodiments, the prizes for feature game play may be set amounts, i.e., non-progressive. In one or more embodiments, the algorithms to determine the amounts may be determined by a statistical percentage based on an average take of a gaming machine and the likelihood of the win over a period of time. In the case where one or more gaming machines are networked, a common award table may be utilized where the award algorithms are determined based on an average take (total wagers) of all the networked gaming machines and the likelihood of a win of an award over a period of time. Each award may be calculated in a similar manner based on the likelihood of a winning outcome being achieved during a game play session.

Figure 4:
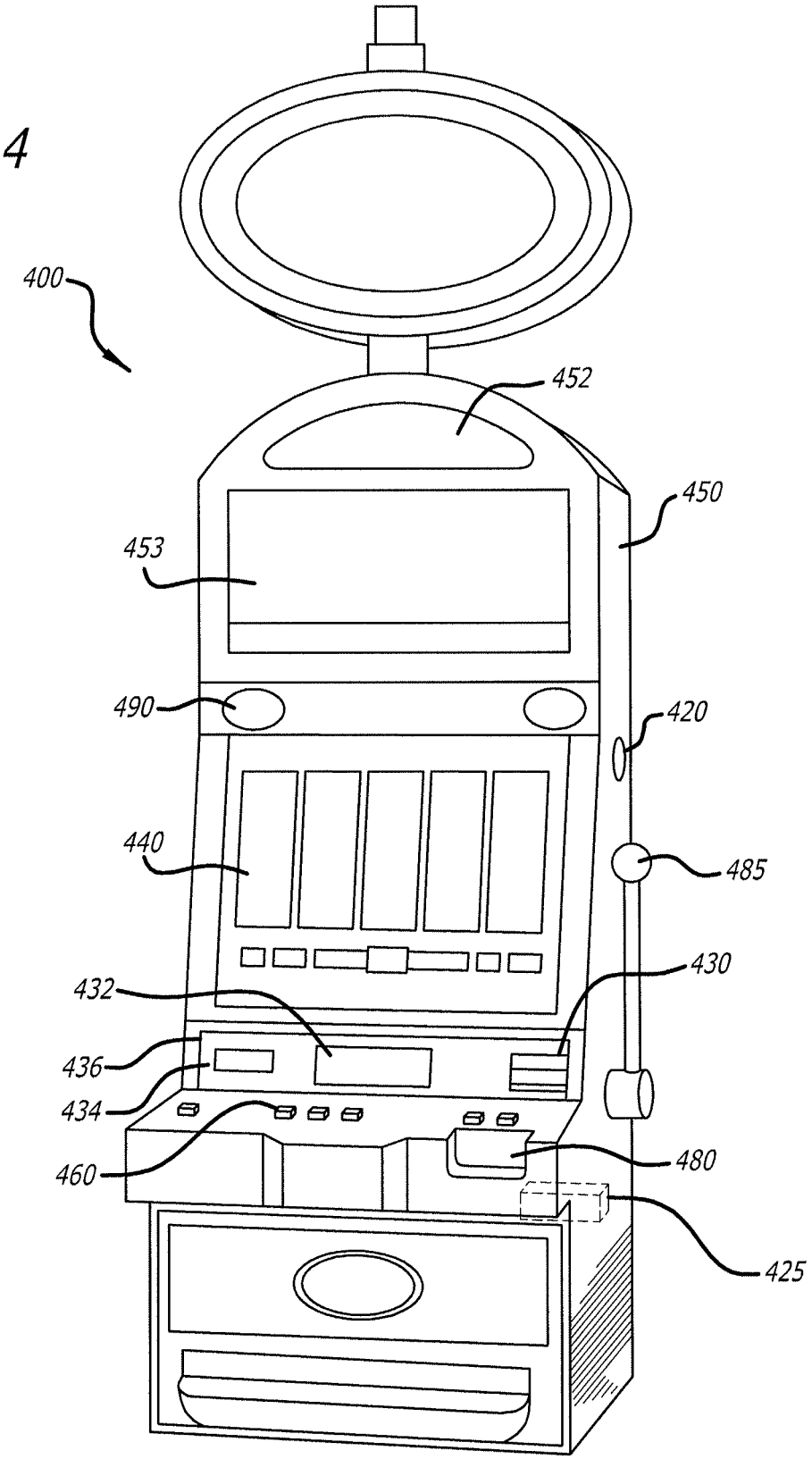
FIG. 4 is a perspective view of a gaming machine in accordance with one or more embodiments.

Referring to FIG. 4, gaming machine 400 is shown, in accordance with one or more embodiments, including cabinet housing 420, processor 425, primary game display 440 upon which a primary game and feature game may be displayed, top box 450 which may display multiple progressives that may be won during play of the feature game, player-activated buttons 460, player tracking panel 436, bill/voucher acceptor 480 and one or more speakers 490. Cabinet housing 420 may be a self-standing unit that is generally rectangular in shape and may be manufactured with reinforced steel or other rigid materials which are resistant to tampering and vandalism. Cabinet housing 420 may alternatively be a handheld device including the gaming functionality as discussed herein and including various components described herein. For example, a handheld device may be a cell phone, personal data assistant, or laptop or tablet computer, each of which may include a display, a processor, and memory sufficient to support either stand-alone capability, such as gaming machine 400, or thin client capability, such as that incorporating some of the capability of a remote server.

In one or more embodiments, cabinet housing 420 houses a processor, circuitry, and software (not shown) for receiving signals from the player-activated buttons 460, operating the games, and transmitting signals to the respective displays and speakers. Any shaped cabinet may be implemented with any embodiment of gaming machine 400 so long as it provides access to a player for playing a game. For example, cabinet 420 may comprise a slant-top, bar-top, or tabletop style cabinet, including a Bally Cinevision™ or CineReels™ cabinet. The operation of gaming machine 400 is described more fully below.

The plurality of player-activated buttons 460 may be used for various functions such as, but not limited to, selecting a wager denomination, selecting a game to be played, selecting a wager amount per game, initiating a game, or cashing out money from gaming machine 400. Buttons 460 may be operable as input mechanisms and may include mechanical buttons, electromechanical buttons or touch screen buttons. Optionally, a handle 485 may be rotated by a player to initiate a game.

In one or more embodiments, buttons 460 may be replaced with various other input mechanisms known in the art such as, but not limited to, a touch screen system, touch pad, track ball, mouse, switches, toggle switches, or other input means used to accept player input. For example, one input means is a universal button module as disclosed in U.S. application Ser. No. 11/106,212, entitled "Universal Button Module," filed on Apr. 14, 2005, which is hereby incorporated by reference. Generally, the universal button module provides a dynamic button system adaptable for use with various games and capable of adjusting to gaming systems having frequent game changes. More particularly, the universal button module may be used in connection with playing a game on a gaming machine and may be used for such functions as selecting the number of credits to bet per hand.

Cabinet housing 420 may optionally include top box 450 which contains "top glass" 452 comprising advertising or payout information related to the game or games available on gaming machine 400. Player tracking panel 436 includes player tracking card reader 434 and player tracking display 432. Voucher printer 430 may be integrated into player tracking panel 436 or installed elsewhere in cabinet housing 420 or top box 450.

Game display 440 may present a game of chance wherein a player receives one or more outcomes from a set of potential outcomes. For example, one such game of chance is a video slot machine game. In other aspects of the disclosed embodiment, gaming machine 400 may present a video or mechanical reel slot machine, a video keno game, a lottery game, a bingo game, a Class II bingo game, a roulette game, a craps game, a blackjack game, a mechanical or video representation of a wheel game or the like.

Mechanical or video/mechanical embodiments may include game displays such as mechanical reels, wheels, or dice as required to present the game to the player. In video/mechanical or pure video embodiments, game display 440 is, typically, a CRT or a flat-panel display in the form of, but not limited to, liquid crystal, plasma, electroluminescent, vacuum fluorescent, field emission, or any other type of panel display known or developed in the art. Game display 440 may be mounted in either a "portrait" or "landscape" orientation and be of standard or "widescreen" dimensions (i.e., a ratio of one dimension to another of at least 16×9). For example, a widescreen display may be 32 inches wide by 18 inches tall. A widescreen display in a "portrait" orientation may be 32 inches tall by 18 inches wide. Additionally, game display 440 preferably includes a touch screen or touch glass system (not shown) and presents player interfaces such as, but not limited to, credit meter (not shown), win meter (not shown) and touch screen buttons (not shown). An example of a touch glass system is disclosed in U.S. Pat. No. 6,942,571, entitled "Gaming Device with Direction and Speed Control of Mechanical Reels Using Touch Screen," which is hereby incorporated by reference.

Game display 440 may also present information such as, but not limited to, player information, advertisements and casino promotions, graphic displays, news and sports updates, or even offer an alternate game. This information may be generated through a host computer networked with gaming machine 400 on its own initiative, or it may be obtained by request of the player using either one or more of the plurality of player-activated buttons 460; the game display itself, if game display 440 comprises a touch screen or similar technology; buttons (not shown) mounted about game display 440 which may permit selections such as those found on an ATM machine, where legends on the screen are associated with respective selecting buttons; or any player input device that offers the required functionality.

Cabinet housing 420 incorporates a single game display 440. However, in alternate embodiments, cabinet housing 420 or top box 450 may house one or more additional displays 453 or components used for various purposes including additional game play screens, animated "top glass," progressive meters or mechanical or electromechanical devices (not shown) such as, but not limited to, wheels, pointers or reels. The additional displays may or may not include a touch screen or touch glass system.

Figure 5A:
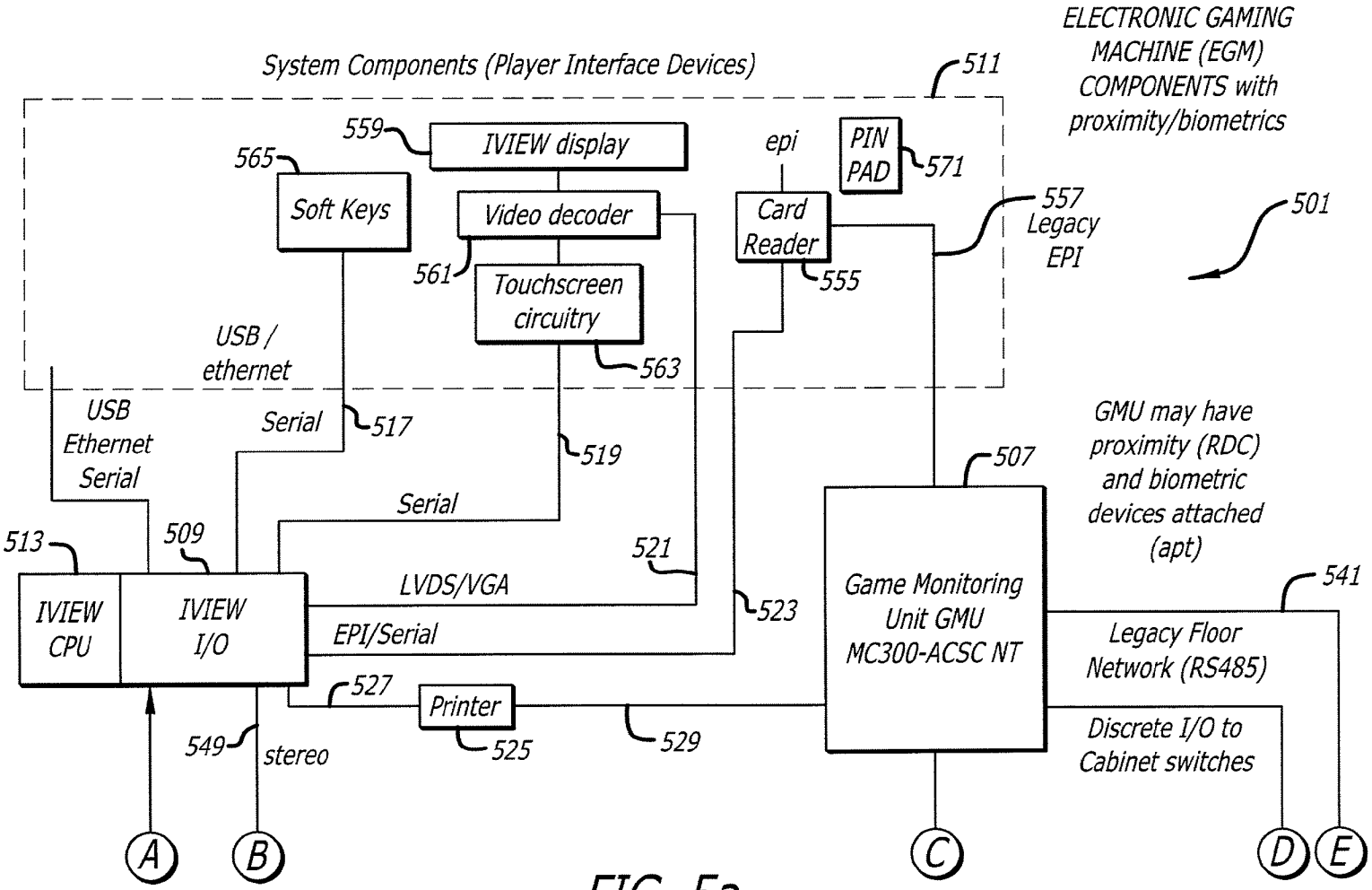
FIG. 5 is a block diagram of the physical and logical components of the gaming machine of FIG. 4 in accordance with one or more embodiments.
Figure 5B:
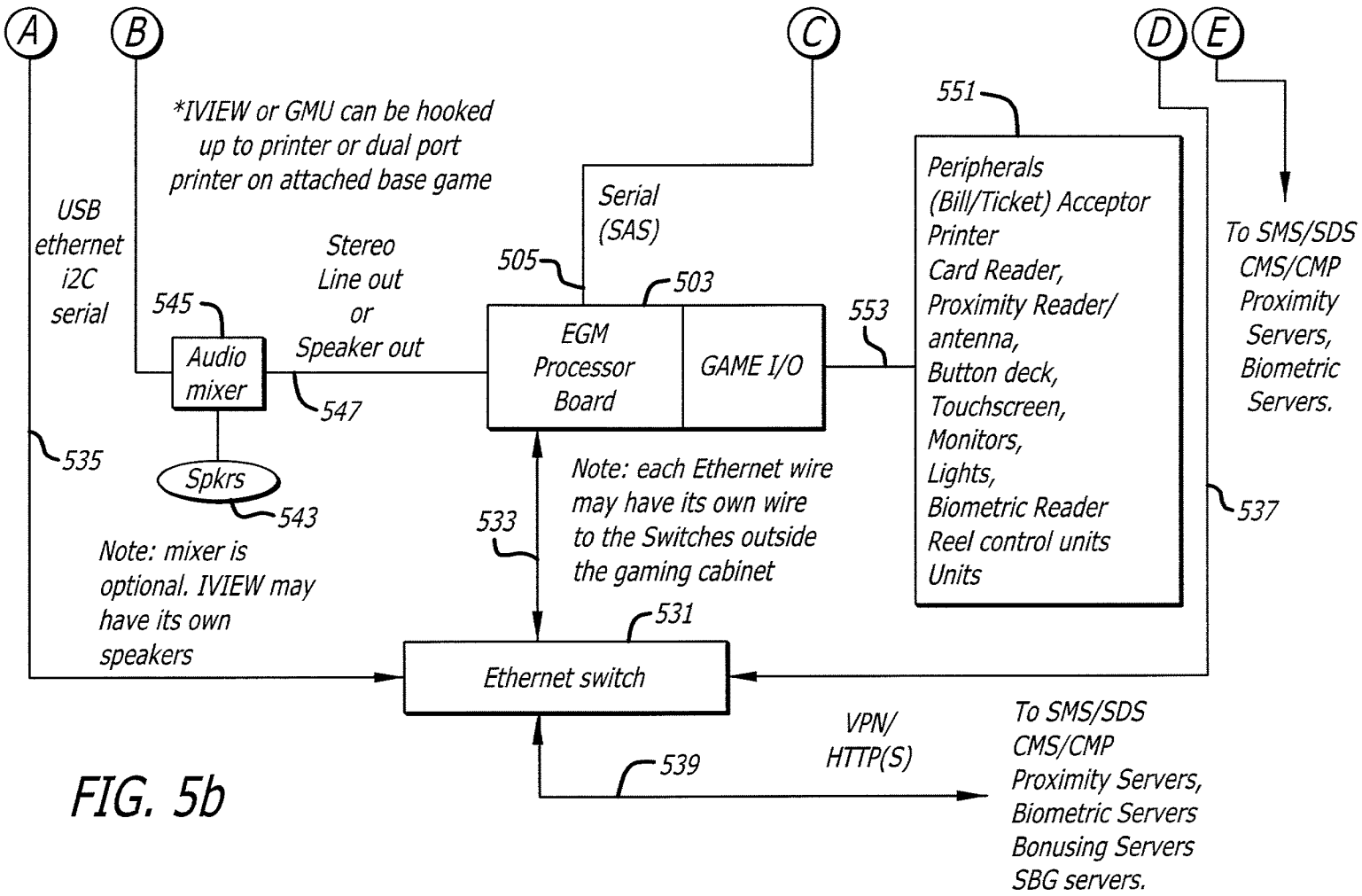

Referring to FIG. 5, electronic gaming machine 501 is shown in accordance with one or more embodiments. Electronic gaming machine 501 includes base game integrated circuit board 503 (EGM Processor Board) connected through serial bus line 505 to game monitoring unit (GMU) 507 (such as a Bally MC300 or ACSC NT), and player interface integrated circuit board (PIB) 509 connected to player interface devices 511 over bus lines 513, 515, 517, 519, 521, 523. Printer 525 is connected to PIB 509 and GMU 507 over bus lines 527, 529, base game integrated circuit board 503, PIB 509, and GMU 507 connect to Ethernet switch 531 over bus lines 533, 535, 537. Ethernet switch 531 connects to a slot management system (SMS) and a casino management system (CMS) network over bus line 539. GMU 507 also may connect to the SMS and CMS network over bus line 541. Speakers 543 connect through audio mixer 545 and bus lines 547, 549 to base game integrated circuit board 503 and PIB 509. The proximity and biometric devices and circuitry may be installed by upgrading a commercially available PIB 509, such as a Bally iView unit. Coding executed on base game integrated circuit board 503, PIB 509, and/or GMU 507 may be upgraded to integrate a game having adjustable multi-part indicia as is more fully described herein.

Peripherals 551 connect through I/O board 553 to base game integrated circuit board 503. For example, a bill/ticket acceptor is typically connected to a game input-output board 553 which is, in turn, connected to a conventional central processing unit ("CPU") base game integrated circuit board 503, such as an Intel Pentium microprocessor mounted on a gaming motherboard. I/O board 553 may be connected to base game integrated circuit board 503 by a serial connection such as RS-232 or USB or may be attached to the processor by a bus such as, but not limited to, an ISA bus. The gaming motherboard may be mounted with other conventional components, such as are found on conventional personal computer motherboards, and loaded with a game program which may include a gaming machine operating system (OS), such as a Bally Alpha OS base game integrated circuit board 503 which executes a game program that causes base game integrated circuit board 503 to play a game. In one embodiment, the game program provides a slot machine game having adjustable multi-part indicia. The various components and included devices may be installed with conventionally and/or commercially available components, devices, and circuitry into a conventional and/or commercially available gaming machine cabinet, examples of which are described above.

When a player has inserted a form of currency such as, for example and without limitation, paper currency, coins or tokens, cashless tickets or vouchers, electronic funds transfers or the like into the currency acceptor, a signal is sent by way of I/O board 553 to base game integrated circuit board 503 which, in turn, assigns an appropriate number of credits for play in accordance with the game program. The player may further control the operation of the gaming machine by way of other peripherals 551, for example, to select the amount to wager via electromechanical or touch screen buttons. The game starts in response to the player operating a start mechanism such as a handle or touch screen icon. The game program includes a random number generator to provide a display of randomly selected indicia on one or more displays. In some embodiments, the random generator may be physically separate from gaming machine 400; for example, it may be part of a central determination host system which provides random game outcomes to the game program. Thereafter, the player may or may not interact with the game through electromechanical or touch screen buttons to change the displayed indicia. Finally, base game integrated circuit board 503 under control of the game program and OS compares the final display of indicia to a pay table. The set of possible game outcomes may include a subset of outcomes related to the triggering of a feature game. In the event the displayed outcome is a member of this subset, base game integrated circuit board 503, under control of the game program and by way of I/O Board 553, may cause feature game play to be presented on a feature display.

Predetermined payout amounts for certain outcomes, including feature game outcomes, are stored as part of the game program. Such payout amounts are, in response to instructions from base game integrated circuit board 503, provided to the player in the form of coins, credits or currency via I/O board 553 and a pay mechanism, which may be one or more of a credit meter, a coin hopper, a voucher printer, an electronic funds transfer protocol or any other payout means known or developed in the art.

In various embodiments, the game program is stored in a memory device (not shown) connected to or mounted on the gaming motherboard. By way of example, but not by limitation, such memory devices include external memory devices, hard drives, CD-ROMs, DVDs, and flash memory cards. In an alternative embodiment, the game programs are stored in a remote storage device. In one embodiment, the remote storage device is housed in a remote server. The gaming machine may access the remote storage device via a network connection, including but not limited to, a local area network connection, a TCP/IP connection, a wireless connection, or any other means for operatively networking components together. Optionally, other data including graphics, sound files and other media data for use with the EGM are stored in the same or a separate memory device (not shown). Some or all of the game program and its associated data may be loaded from one memory device into another, for example, from flash memory to random access memory (RAM).

In one or more embodiments, peripherals may be connected to the system over Ethernet connections directly to the appropriate server or tied to the system controller inside the EGM using USB, serial or Ethernet connections. Each of the respective devices may have upgrades to their firmware utilizing these connections.

GMU 507 includes an integrated circuit board and GMU processor and memory including coding for network communications, such as the G2S (game-to-system) protocol from the Gaming Standards Association, Las Vegas, Nev., used for system communications over the network. As shown, GMU 507 may connect to card reader 555 through bus 557 and may thereby obtain player card information and transmit the information over the network through bus 541. Gaming activity information may be transferred by the base game integrated circuit board 503 to GMU 507 where the information may be translated into a network protocol, such as S2S, for transmission to a server, such as a player tracking server, where information about a player's playing activity may be stored in a designated server database.

PIB 509 includes an integrated circuit board. PID processor, and memory which includes an operating system, such as Windows CE, a player interface program which may be executable by the PID processor together with various input/output (I/O) drivers for respective devices which connect to PIB 509, such as player interface devices 511, and which may further include various games or game components playable on PIB 509 or on a connected network server and PIB 509 is operable as the player interface. PIB 509 connects to card reader 555 through bus 523, display 559 through video decoder 561 and bus 521, such as an LVDS or VGA bus.

As part of its programming, the PID processor executes coding to drive display 559 and provides messages and information to a player. Touch screen circuitry interactively connects display 559 and video decoder 561 to PIB 509, such that a player may input information and cause the information to be transmitted to PIB 509 either on the player's initiative or responsive to a query by PIB 509. Additionally, soft keys 565 connect through bus 517 to PIB 509 and operate together with display 559 to provide information or queries to a player and receive responses or queries from the player. PIB 509, in turn, communicates over the CMS/SMS network through Ethernet switch 531 and busses 535, 539 and with respective servers, such as a player tracking server.

Player interface devices 511 are linked into the virtual private network of the system components in gaming machine 501. The system components include the iVIEW processing board and game monitoring unit (GMU) processing board. These system components may connect over a network to the slot management system (such as a commercially available Bally SDS/SMS) and/or a casino management system (such as a commercially available Bally CMP/CMS).

The GMU system component has a connection to the base game through a serial SAS connection and is connected to various servers using, for example, HTTPs over Ethernet. Through this connection, firmware, media, operating system software, and gaming machine configurations can be downloaded to the system components from the servers. This data is authenticated prior to installing on the system components.

The system components include the iVIEW processing board and game monitoring unit (GMU) processing board. The GMU and iVIEW can combined into one like the commercially available Bally GTM iVIEW device. This device may have a video mixing technology to mix the EGM processor's video signals with the iVIEW display onto the top box monitor or any monitor on the gaming device.

Figure 6:
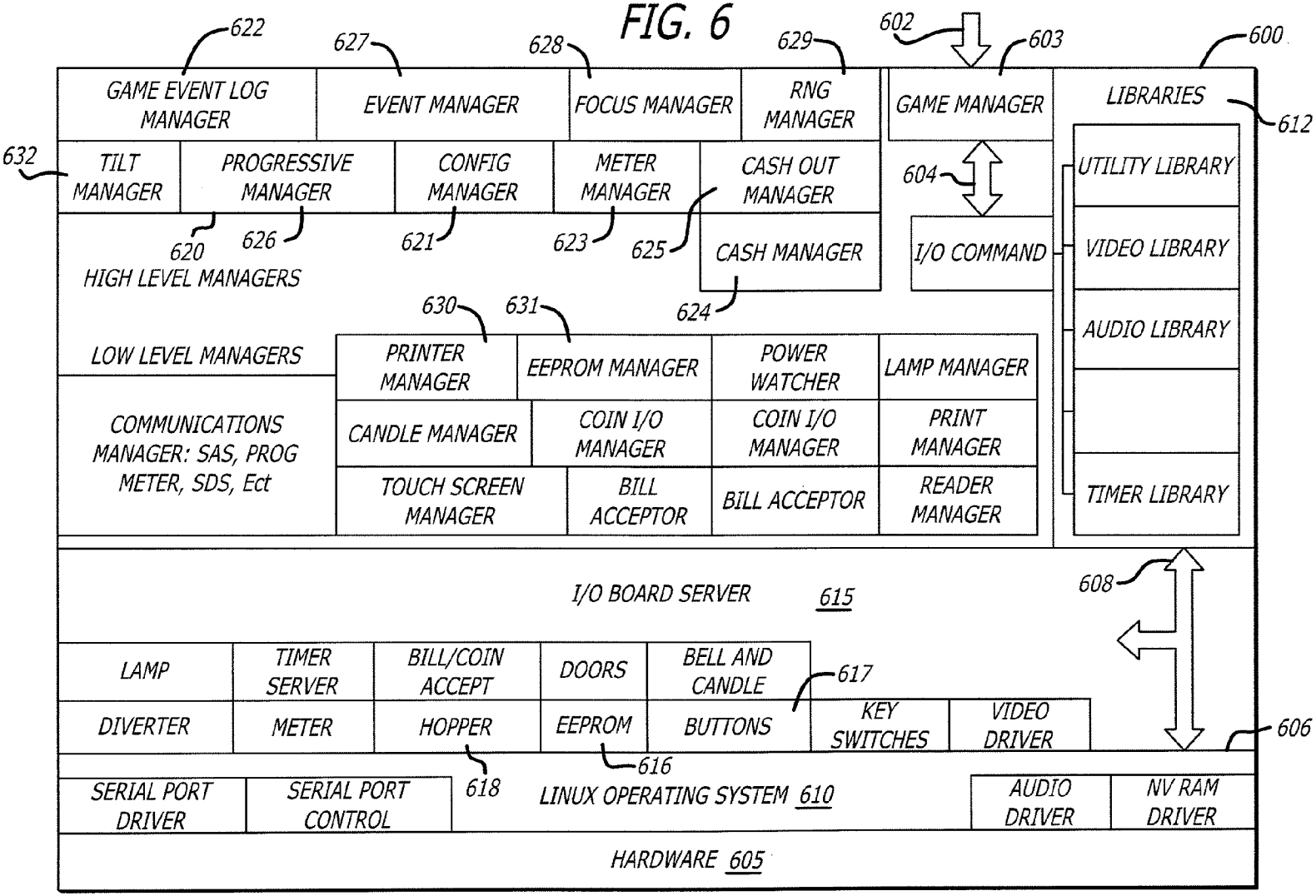
FIG. 6 is a block diagram of the logical components of a gaming kernel in accordance with one or more embodiments.

In accordance with one or more embodiments, FIG. 6 is a functional block diagram of a gaming kernel 600 of a game program under control of base game integrated circuit board 503. The game program uses gaming kernel 600 by calling into the application programming interface (API) 602, which is part of game manager 603. The components of game kernel 600, as shown in FIG. 6, are only illustrative, and should not be considered limiting. For example, the number of managers may be changed, additional managers may be added or some managers may be removed without deviating from the scope and spirit of the disclosed embodiments.

As shown in the example, there are three layers: a hardware layer 605; an operating system layer 610, such as, but not limited to, Linux; and a game kernel layer 600 having game manager 603 therein. In one or more embodiments, the use of a standard operating system 610, such a UNIX-based or Windows-based operating system, allows game developers interfacing to the gaming kernel to use any of a number of standard development tools and environments available for the operating systems. This is in contrast to the use of proprietary, low-level interfaces, which may require significant time and engineering investments for each game upgrade, hardware upgrade, or feature upgrade. The game kernel layer 600 executes at the user level of the operating system 610, and itself contains a major component called the I/O Board Server 615. To properly set the bounds of game application software (making integrity checking easier), all game applications interact with gaming kernel 600 using a single API 602 in game manager 603. This enables game applications to make use of a well-defined, consistent interface, as well as controlling access points to gaming kernel 600 controlled, where overall access is controlled using separate processes.

For example, game manager 603 parses an incoming command stream and, when a command dealing with I/O comes in (arrow 604), the command is sent to an applicable library routine 612. Library routine 612 decides what it needs from a device and sends commands to I/O Board Server 615 (see arrow 608). A few specific drivers remain in operating system 610's kernel, shown as those below line 606. These are built-in, primitive, or privileged drivers that are (i) general (ii) kept to a minimum and (iii) are easier to leave than extract. In such cases, the low-level communications is handled within operating system 610 and the contents passed to library routines 612.

Thus, in a few cases library routines may interact with drivers inside operating system 610, which is why arrow 608 is shown as having three directions (between library utilities 612 and I/O Board Server 615, or between library utilities 612 and certain drivers in operating system 610). No matter which path is taken, the logic needed to work with each device is coded into modules in the user layer of the diagram. Operating system 610 is kept as simple, stripped down, and common across as many hardware platforms as possible. The library utilities and user-level drivers change as dictated by the game cabinet or game machine in which it will run. Thus, each game cabinet or game machine may have a base game integrated circuit board 503 connected to a unique, relatively dumb, and as inexpensive as possible, I/O adapter board 540, plus a gaming kernel 600 which will have the game-machine-unique library routines and I/O Board Server 615 components needed to enable game applications to interact with the gaming machine cabinet. Note that these differences are invisible to the game application software with the exception of certain functional differences (i.e., if a gaming cabinet has stereo sound, the game application will be able to make use of API 602 to use the capability over that of a cabinet having traditional monaural sound).

Game manager 603 provides an interface into game kernel 600, providing consistent, predictable, and backwards-compatible calling methods, syntax, and capabilities by way of game application API 602. This enables the game developer to be free of dealing directly with the hardware, including the freedom to not have to deal with low-level drivers as well as the freedom to not have to program lower-level managers 630, although lower-level managers 630 may be accessible through game manager 603's interface 602 if a programmer has the need. In addition to the freedom derived from not having to deal with the hardware level drivers and the freedom of having consistent, callable, object-oriented interfaces to software managers of those components (drivers), game manager 603 provides access to a set of upper level managers 620 also having the advantages of consistent callable, object-oriented interfaces, and further providing the types and kinds of base functionality required in casino-type games. Game manager 603, providing all the advantages of its consistent and richly functional interface 602 as supported by the rest of game kernel 600, thus provides a game developer with a multitude of advantages.

Game manager 603 may have several objects within itself, including an initialization object (not shown). The initialization object performs the initialization of the entire game machine, including other objects, after game manager 603 has started its internal objects and servers in appropriate order. In order to carry out this function, the kernel's configuration manager 621 is among the first objects to be started. Configuration manager 621 has data needed to initialize and correctly configure other objects or servers.

The upper level managers 620 of game kernel 600 may include game event log manager 622 which provides, at the least, a logging or logger base class, enabling other logging objects to be derived from this base object. The logger object is a generic logger; that is, it is not aware of the contents of logged messages and events. The log manager's (622) job is to log events in non-volatile event log space. The size of the space may be fixed, although the size of the logged event is typically not. When the event space or log space fills up, one embodiment will delete the oldest logged event (each logged event will have a time/date stamp, as well as other needed information such as length), providing space to record the new event. In this embodiment, the most recent events will thus be found in the log space, regardless of their relative importance. Further provided is the capability to read the stored logs for event review.

In accordance with one embodiment, meter manager 623 manages the various meters embodied in the game kernel 600. This includes the accounting information for the game machine and game play. There are hard meters (counters) and soft meters; the soft meters may be stored in non-volatile storage such as non-volatile battery-backed RAM to prevent loss. Further, a backup copy of the soft meters may be stored in a separate, non-volatile storage such as EEPROM. In one embodiment, meter manager 623 receives its initialization data for the meters, during startup, from configuration manager 621. While running, the cash in (624) and cash out (625) managers call the meter manager's (623) update functions to update the meters. Meter manager 623 will, on occasion, create backup copies of the soft meters by storing the soft meters' readings in EEPROM. This is accomplished by calling and using EEPROM manager 631.

In accordance with still other embodiments, progressive manager 626 manages progressive games playable from the game machine. Event manager 627 is generic, like log manager 622, and is used to manage various gaming machine events. Focus manager 628 correlates which process has control of various focus items. Tilt manager 632 is an object that receives a list of errors (if any) from configuration manager 621 at initialization, and during game play from processes, managers, drivers, and the like, that may generate errors. Random number generator manager 629 is provided to allow easy programming access to a random number generator (RNG), as a RNG is required in virtually all casino-style (gambling) games. RNG manager 629 includes the capability of using multiple seeds.

In accordance with one or more embodiments, a credit manager object (not shown) manages the current state of credits (cash value or cash equivalent) in the game machine, including any available winnings, and further provides denomination conversion services. Cash out manager 625 has the responsibility of configuring and managing monetary output devices. During initialization, cash out manager 625, using data from configuration manager 621, sets the cash out devices correctly and selects any selectable cash out denominations. During play, a game application may post a cash out event through the event manager 627 (the same way all events are handled), and using a callback posted by cash out manager 625, cash out manager 625 is informed of the event. Cash out manager 625 updates the credit object, updates its state in nonvolatile memory, and sends an appropriate control message to the device manager that corresponds to the dispensing device. As the device dispenses dispensable media, there will typically be event messages being sent back and forth between the device and cash out manager 625 until the dispensing finishes, after which cash out manager 625, having updated the credit manager and any other game state (such as some associated with meter manager 623) that needs to be updated for this set of actions and sends a cash out completion event to event manager 627 and to the game application thereby. Cash in manager 624 functions similarly to cash out manager 625, only controlling, interfacing with, and taking care of actions associated with cashing in events, cashing in devices, and associated meters and crediting.

In a further example, in accordance with one or more embodiments, I/O server 615 may write data to the gaming machine EEPROM memory, which is located in the gaming machine cabinet and holds meter storage that must be kept even in the event of power failure. Game manager 603 calls the I/O library functions to write data to the EEPROM. The I/O server 615 receives the request and starts a low priority EEPROM thread 616 within I/O server 615 to write the data. This thread uses a sequence of 8 bit command and data writes to the EEPROM device to write the appropriate data in the proper location within the device. Any errors detected will be sent as IPC messages to game manager 603. All of this processing is asynchronous.

In accordance with one embodiment, button module 617 within I/O server 615, polls (or is sent) the state of buttons every 2 milliseconds. These inputs are debounced by keeping a history of input samples. Certain sequences of samples are required to detect a button was pressed, in which case the I/O server 615 sends an inter-process communication event to game manager 603 that a button was pressed or released. In some embodiments, the gaming machine may have intelligent distributed I/O which debounces the buttons, in which case button module 617 may be able to communicate with the remote intelligent button processor to get the button events and simply relay them to game manager 603 via IPC messages. In still another embodiment, the I/O library may be used for pay out requests from the game application. For example, hopper module 618 must start the hopper motor, constantly monitor the coin sensing lines of the hopper, debounce them, and send an IPC message to the game manager 603 when each coin is paid.

Further details, including disclosure of lower level fault handling and/or processing, are included in U.S. Pat. No. 7,351,151 entitled "Gaming Board Set and Gaming Kernel for Game Cabinets" and provisional U.S. patent application No. 60/313,743, entitled "Form Fitting Upgrade Board Set For Existing Game Cabinets," filed Aug. 20, 2001. Both this patent and provisional application are fully incorporated herein by explicit reference.

Figure 7:
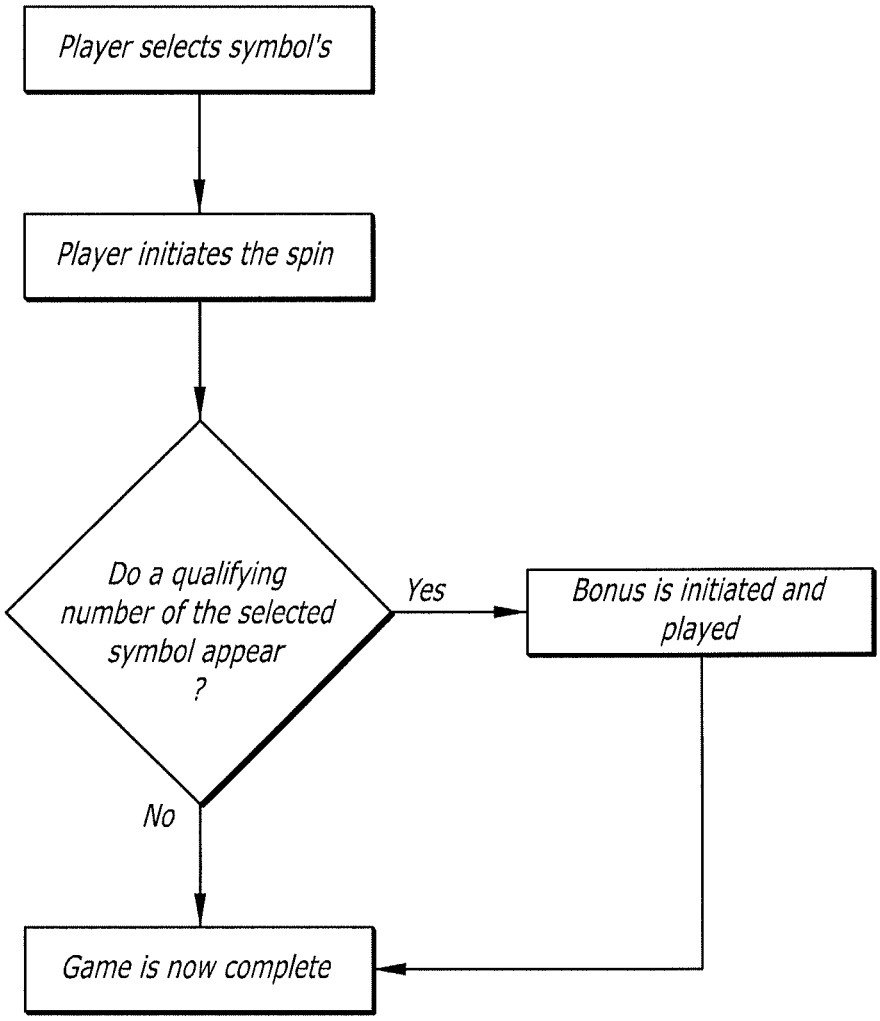
FIG. 7 is a functional block diagram depicting the steps associated with carrying out an example method in accordance with one or more embodiments.

A logical flow diagram generally depicting the steps associated with a method 700 for carrying out a game having a hot pick bonus, in accordance with one aspect of the disclosed embodiment, is presented in FIG. 7. The order of actions as shown in FIG. 7 is only illustrative, and should not be considered limiting. For example, the order of the actions may be changed, additional steps may be added or some steps may be removed without deviating from the scope and spirit of the disclosed embodiments.

Figure 8A:
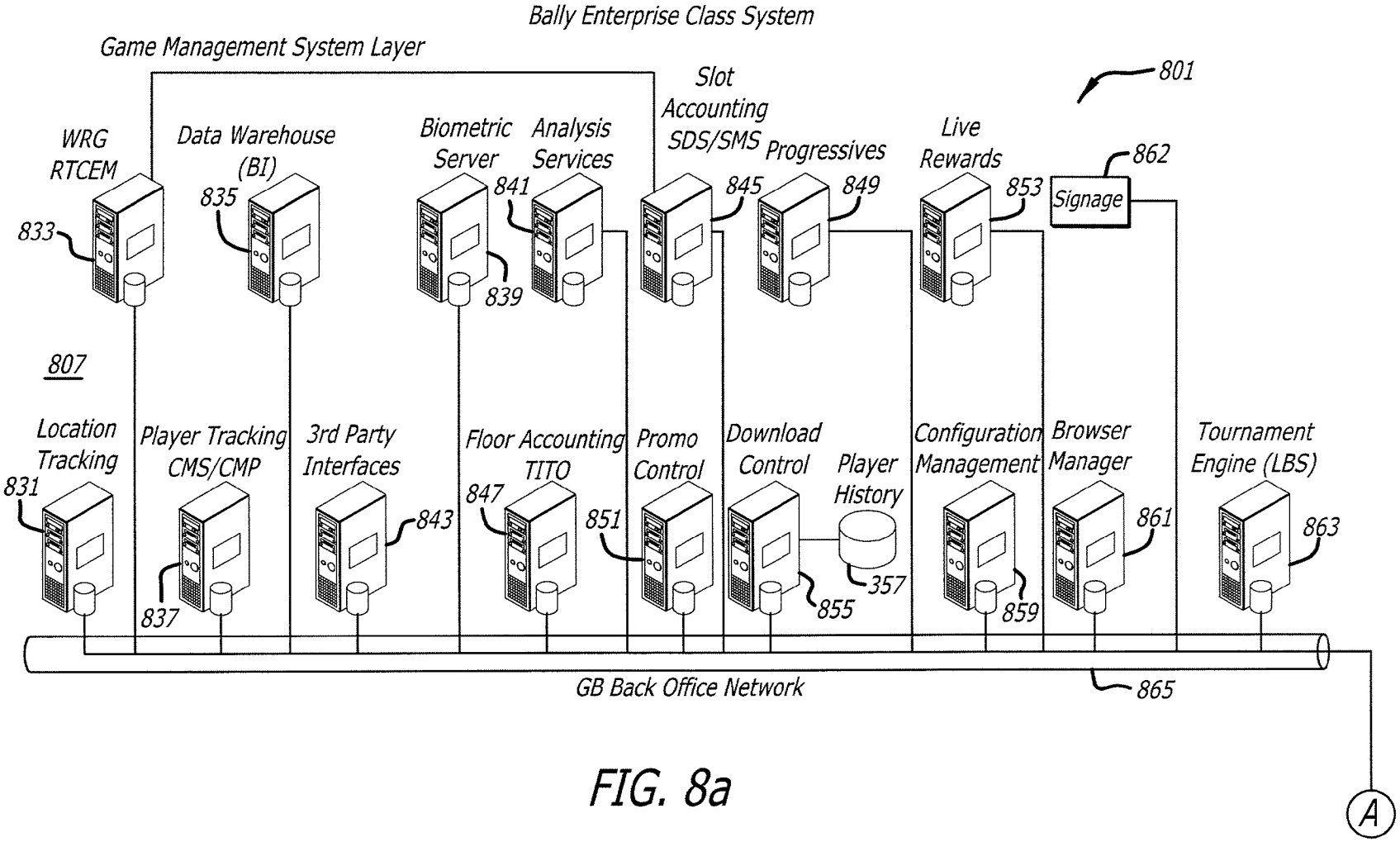
FIG. 8 is a schematic block diagram showing the hardware elements of a networked gaming system in accordance with one or more embodiments.
Figure 8B:
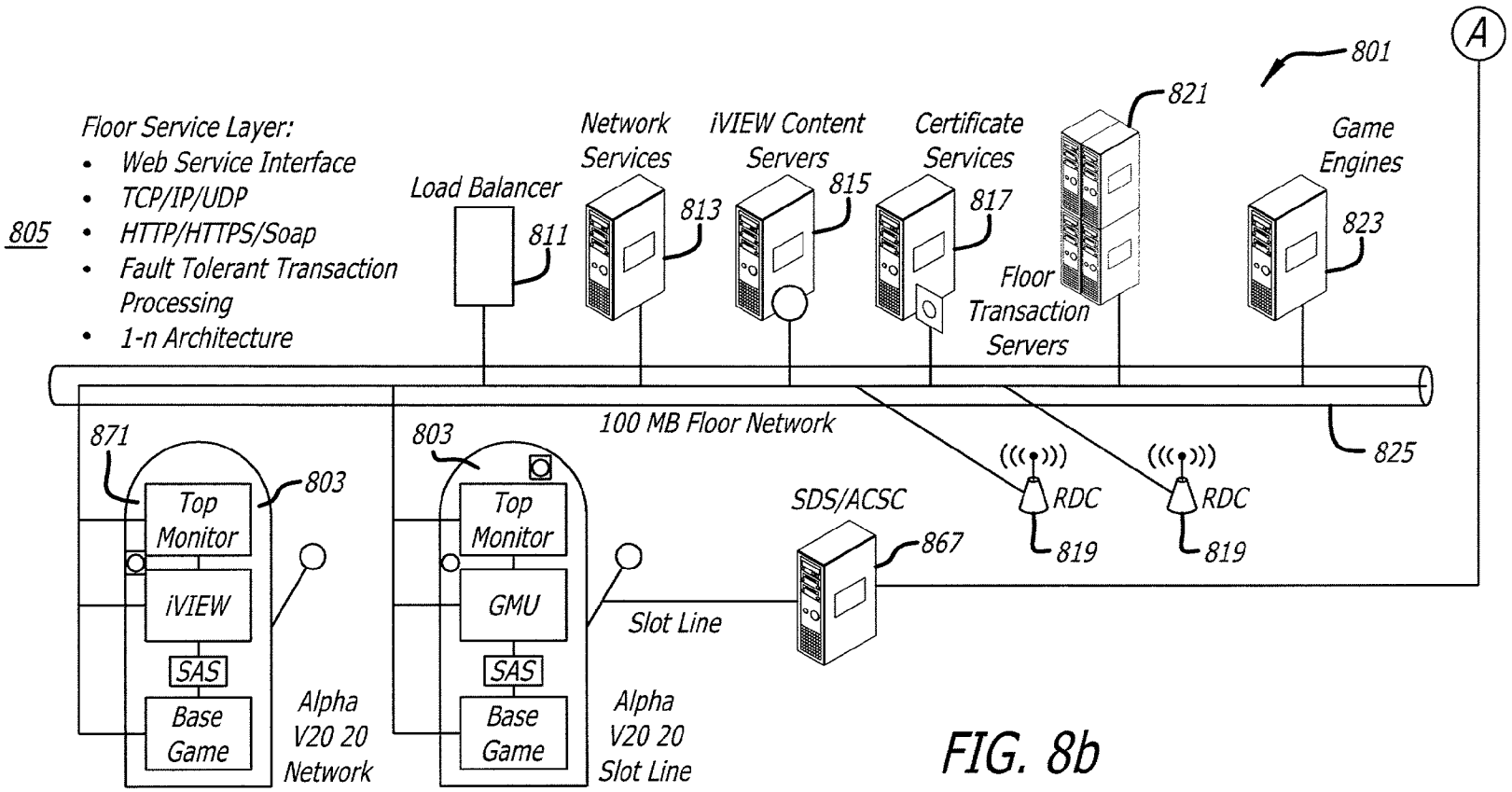

Referring to FIG. 8, enterprise gaming system 801 is shown in accordance with one or more embodiments. Enterprise gaming system 801 may include one casino or multiple locations and generally includes a network of gaming machines 803, floor management system (SMS) 805, and casino management system (CMS) 807. SMS 805 may include load balancer 811, network services servers 813, player interface (iVIEW) content servers 815, certificate services server 817, floor radio dispatch receiver/transmitters (RDC) 819, floor transaction servers 821 and game engines 823, each of which may connect over network bus 825 to gaming machines 803. CMS 807 may include location tracking server 831, WRG RTCEM server 833, data warehouse server 835, player tracking server 837, biometric server 839, analysis services server 841, third party interface server 843, slot accounting server 845, floor accounting server 847, progressives server 849, promo control server 851, bonus game (such as Bally Live Rewards) server 853, download control server 855, player history database 857, configuration management server 859, browser manager 861, tournament engine server 863 connecting through bus 865 to server host 867 and gaming machines 803. The various servers and gaming machines 803 may connect to the network with various conventional network connections (such as, for example, USB, serial, parallel, RS485, Ethernet). Additional servers which may be incorporated with CMS 807 include a responsible gaming limit server (not shown), advertisement server (not shown), and a control station server (not shown) where an operator or authorized personnel may select options and input new programming to adjust each of the respective servers and gaming machines 803. SMS 805 may also have additional servers including a control station (not shown) through which authorized personnel may select options, modify programming, and obtain reports of the connected servers and devices, and obtain reports. The various CMS and SMS servers are descriptively entitled to reflect the functional executable programming stored thereon and the nature of databases maintained and utilized in performing their respective functions.

Gaming machines 803 include various peripheral components that may be connected with USB, serial, parallel, RS-485 or Ethernet devices/architectures to the system components within the respective gaming machine. The GMU has a connection to the base game through a serial SAS connection. The system components in the gaming cabinet may be connected to the servers using HTTPs or G2S over Ethernet. Using CMS 807 and/or SMS 305 servers and devices, firmware, media, operating systems, and configurations may be downloaded to the system components of respective gaming machines for upgrading or managing floor content and offerings in accordance with operator selections or automatically depending upon CMS 807 and SMS 805 master programming. The data and programming updates to gaming machines 803 are authenticated using conventional techniques prior to install on the system components.

In various embodiments, any of the gaming machines 803 may be a mechanical reel spinning slot machine, video slot machine, video poker machine, keno machine, video blackjack machine, or a gaming machine offering one or more of the above described games including a group play game. Alternately, gaming machines 803 may provide a game with collapsing reels as one of a set of multiple primary games selected for play by a random number generator, as described above. A gaming system of the type described above also allows a plurality of games in accordance with the various embodiments to be linked under the control of a group game server (not shown) for cooperative or competitive play in a particular area, carousel, casino or between casinos located in geographically separate areas. For example, one or more examples of group games under control of a group game server are disclosed in U.S. application Ser. No. 11/938,079, entitled "Networked System and Method for Group Play Gaming," filed on Nov. 9, 2007, which is hereby incorporated by reference in its entirety for all purposes.

The various embodiments described above are provided by way of illustration only and should not be construed to limit the disclosed embodiments. Those skilled in the art will readily recognize various modifications and changes that may be made to the disclosed embodiment without following the example embodiments and applications illustrated and described herein, and without departing from the true spirit and scope of the disclosed embodiments.

What is claimed is:

1. A gaming system for playing a base game and a bonus game having a plurality of symbol indicia that are selectable prior to play of the base game and are associated with the bonus game, the system comprising:

one or more bonus servers that are connected to a physical game network;

a gaming device that is connected to the one or more bonus servers via the physical game network, the gaming device comprising:

an interactive display screen that displays the plurality of selectable symbol indicia to a player and that receives player input, wherein prior to play of the base game that is executed on the gaming device, the player selects one of the plurality of symbol indicia, wherein each of the plurality of symbol indicia is associated with a bonus game that is executed by the one or more bonus servers which has a different bonus hit frequency and bonus prize pay range, enabling the player to select a bonus hit frequency and bonus prize pay range by selecting the associated symbol indicia;

a plurality of reel indicia including the plurality of selectable symbol indicia on the gaming device, wherein the plurality of reel indicia are spun during the play of the base game and wherein the plurality of selectable symbol indicia appear in the base game at different frequencies, and a same number of selectable symbol indicia is required to achieve play of the bonus game, the bonus game being played in a manner independent of the one of the plurality of symbol indicia selected;

one or more player-activated buttons for receiving player input on the gaming device; and a processor on the gaming device, wherein the processor executes game software and processes input from the player-activated buttons;

wherein activation of the base game by the gaming device includes rotating of the plurality of reel indicia, and wherein display of a particular symbol indicia on one or more of the reels after the rotation has stopped determines whether a winning game outcome has occurred;

wherein the bonus game that is executed by the one or more bonus servers has a higher bonus hit frequency and a lower bonus prize pay range or a lower bonus hit frequency and a higher bonus prize pay range.

2. The system of claim 1, wherein the player-activated buttons are touch screen virtual buttons.

3. The system of claim 1, wherein the player-activated buttons are physical buttons.

4. The system of claim 1, wherein the bonus game comprises a full wheel image.

5. The system of claim 1, wherein the bonus game comprises a portion of a wheel image.

6. The system of claim 1, wherein the bonus game includes an animated representation of a wheel image is associated with one or more progressive prizes.

7. The system of claim 1, wherein the bonus game includes the animated representation of a wheel image is associated with one or more non-progressive prizes.

8. The system of claim 1, wherein the plurality of reel indicia are placed behind transparent LCD windows.

9. The system of claim 1, wherein the reel indicia are hidden by the appearance of masked prizes on the LCD windows in front of the plurality of reels when a feature game is triggered.

10. The system of claim 1, wherein, upon touching one of the masked prizes on the LCD windows, the prize value is revealed and awarded to the player.

11. The system of claim 1, wherein the bonus game includes awarding feature play when certain symbols appear on a pay line, when certain symbols are scattered, or when no symbols of a certain type appear, regardless of visible symbols.

12. The system of claim 1, wherein the availability of the bonus game is restricted based on the size of a wager or the placement of the wager.

13. The system of claim 1, wherein a percentage of a wager is used to fund a feature game.

14. The system of claim 1, wherein a probability of winning the feature game is dependent on the size of a wager.

15. A gaming system for playing a base game and a bonus game having a plurality of symbol indicia that are selectable prior to play of the base game and are associated with the bonus game, the system comprising:

one or more bonus servers that are connected to a physical game network;

a gaming device that is connected to the one or more bonus servers via the physical game network, the gaming device comprising:

an interactive display screen that displays the plurality of selectable symbol indicia to a player and that receives player input, wherein prior to play of the base game that is executed on the gaming device, the player selects one of the plurality of symbol indicia, wherein each of the plurality of symbol indicia is associated with a bonus game that is executed by the one or more bonus servers which has a different bonus hit frequency and bonus prize pay range, enabling the player to select a bonus hit frequency and bonus prize pay range by selecting the associated symbol indicia;

base game play indicia including the plurality of selectable symbol indicia on the gaming device, wherein the base game play indicia are activated during the play of the base game and wherein the plurality of selectable symbol indicia appear in the base game at different frequencies, and a same number of selectable symbol indicia is required to achieve play of the bonus game, the bonus game being played in a manner independent of the one of the plurality of symbol indicia selected;

one or more player-activated buttons for receiving player input on the gaming device; and a processor on the gaming device, wherein the processor executes game software and processes input from the player-activated buttons;

wherein activation of the base game by the gaming device includes activation of the base game play indicia, and wherein display of a particular symbol indicia on one or more of the base game play indicia after the base game play activity has stopped determines whether a winning game outcome has occurred;

wherein a bonus game that is executed by the one or more bonus servers has a higher bonus hit frequency has a corresponding lower bonus prize pay range and a bonus game that has a lower bonus hit frequency has a corresponding higher bonus prize pay range.

16. A gaming system for playing a base game and a bonus activity having a plurality of symbol indicia that are selectable prior to play of the base game and are associated with the bonus activity, the system comprising:

one or more bonus servers that are connected to a physical game network;

a gaming device that is connected to the one or more bonus servers via the physical game network, the gaming device comprising:

an interactive display screen that displays the plurality of selectable symbol indicia to a player, wherein prior to play of the base game that is executed on the gaming device, the player selects one of the plurality of symbol indicia, wherein each of the plurality of symbol indicia is associated with a bonus activity that is executed by the one or more bonus servers;

base game play indicia including the plurality of selectable symbol indicia on the gaming device, wherein the base game play indicia are activated during the play of the base game and wherein the plurality of selectable symbol indicia appears in the base game at different frequencies, and a same number of selectable symbol indicia is required to achieve play of the bonus activity that is executed by the one or more bonus servers, the bonus activity being played in a manner independent of the one of the plurality of symbol indicia selected;

one or more player-activated buttons for receiving player input on the gaming device; and a processor on the gaming device, wherein the processor executes game software and processes input from the player-activated buttons;

wherein activation of the base game by the gaming device includes activation of the base game play indicia, and wherein display of a particular symbol indicia on one or more of the base game play indicia after the base game play activity has stopped determines whether a winning game outcome has occurred.

* * * * *